United States Patent [19]

Perret

[11] Patent Number: 4,952,759

[45] Date of Patent: Aug. 28, 1990

[54] CONTROL DEVICE FOR CONTROLLING A CIRCUIT BREAKER

[75] Inventor: Michel Perret, Tramole, France

[73] Assignee: Societe Anonyme dite: Alsthom, Paris, France

[21] Appl. No.: 320,653

[22] Filed: Mar. 8, 1989

[30] Foreign Application Priority Data

Mar. 9, 1988 [FR] France ..... 88 03028

[51] Int. Cl.[5] ..... H01H 35/38

[52] U.S. Cl. ..... 200/82 R; 188/282; 267/127; 267/226; 200/34; 200/82 C; 335/62

[58] Field of Search ..... 188/282 X, 317; 267/225, 226 X, 127 X; 307/118; 335/62 X; 200/34 X, 81 R, 82 R, 82 B, 82 C, 144 B, 148 R, 148 A

[56] References Cited

U.S. PATENT DOCUMENTS

| | | | |
|---|---|---|---|
| 4,342,884 | 8/1982 | Ban | 267/226 |
| 4,387,280 | 6/1983 | Iman | 200/82 R |
| 4,424,952 | 1/1984 | Thompson | 188/317 |
| 4,430,535 | 2/1984 | Berg | 200/34 |
| 4,454,393 | 6/1984 | Volkmar | 200/82 G |
| 4,826,094 | 5/1989 | Whiteley | 188/282 |

FOREIGN PATENT DOCUMENTS 2361972 5/1975 Fed. Rep. of Germany .

*Primary Examiner*—Gerald P. Tolin

*Attorney, Agent, or Firm*—Sughrue, Mion, Zinn, MacPeak & Seas

[57] ABSTRACT

The invention relates to a control device for a circuit breaker. The circuit breaker is controlled mechanically by an engagement spring (8), by a disengagement spring (2), and by a hydraulic transmission for transmitting a portion of the energy in the engagement spring to the disengagement spring. The device has circular symmetry about a longitudinal axis.

4 Claims, 5 Drawing Sheets

CONTROL DEVICE FOR CONTROLLING A CIRCUIT BREAKER

The present invention relates to a control device for controlling a circuit breaker, the device being of the type comprising a disengagement spring and an engagement spring.

BACKGROUND OF THE INVENTION

In a device of this type, a motor provides energy to the engagement spring. Thereafter, the engagement spring gives a portion of its energy to the disengagement spring, and said transfer of energy requires the presence of various mechanical members, and in particular of a cam which needs to move out of the way after transferring energy so as to make subsequent operation of the disengagement spring possible.

These mechanical members have low efficiency and are subject to wear and to play, requiring adjustment and maintenance. It would be desirable to replace the mechanical transfer members by means which are free from wear and play.

Proposals have been made, in particular in the document DT 2 361 972 A1 to provide control in which the engagement spring transmits a portion of its energy to the disengagement spring by hydraulic means. However the embodiment proposed is complex and expensive.

An aim of the invention is to provide a control device in which all of the parts share a common axis of symmetry, thereby obtaining advantageous savings in implementation and in assembly.

SUMMARY OF THE INVENTION

The aims of the invention are achieved by implementing a mechanical control device for controlling a circuit breaker, said device comprising an engagement spring and a disengagement spring together with hydraulic means for transmitting a portion of the energy in the engagement spring to said disengagement spring, the device compriing a part which is moveable relative to a fixed frame, said part comprising a rod connected to an operating member of the circuit breaker and a first cylinder which is closed by a piston that is extended by a body of revolution capable of sliding in sealed manner about a collar which is stationary relative to said frame, the disengagement spring surrounding said first cylinder and bearing firstly against said frame and secondly against a collar fixed to the first cylinder, the engagement spring being placed inside the cylindrical body and bearing firstly against said piston and secondly on said collar which is fixed relative to said frame, with the inside volumes of the first cylinder and of said cylindrical body being filled with a liquid and being capable of being put into communication with each other firstly via a piston orifice which is closable by a valve, and secondly via a non-return valve allowing liquid to pass only from the cylindrical body towards the first cylinder.

BRIEF DESCRIPTION OF THE DRAWINGS

An embodiment of the invention is described by way of example with reference to the accompanying drawings, in which.

DETAILED DESCRIPTION

Figure 1:
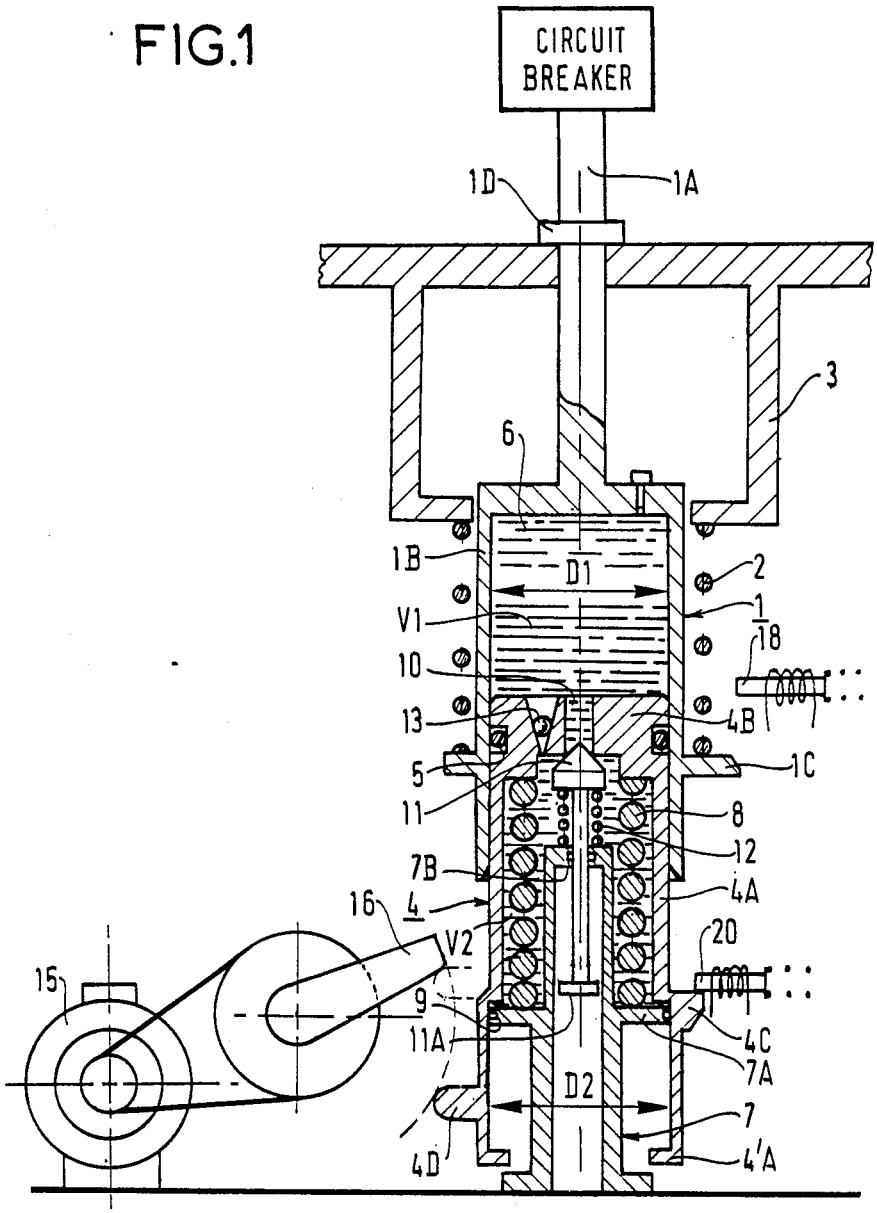
FIG. 1 is a diagrammatic axial section through a control device in accordance with the invention, showing the disengagement spring relaxed and the engagement spring under compression.

FIG. 1 shows a moving portion 1 comprising a rod 1A connected to the control rod (not shown) of the circuit breaker to be controlled.

The moving portion also comprises a cylindrical portion 1B having an inside diameter D1 and provided with an outer collar 1C serving as an abutment for a first end of a spring 2 which constitutes the disengagement spring.

The other end of the spring bears against a frame 3 which also serves as a member for guiding the cylinder 1B and the rod 1A. A collar 1D on the rod 1A serves as an end-of-stroke abutment for the moving portion during the circuit breaker disengaging stage.

A part 4 is slidably received inside the cylinder 1B and comprises a cylindrical body constituted by two coaxial cylinders 4A and 4'A together with a piston 4B. In conjunction with the cylinder 1B, the piston 4B delimits a variable volume V1. Piston sealing is obtained by means of a piston ring 5.

The cylinder 4A is guided by a fixed part 7 which is fixed to the frame of the control device and which carries a collar 7A which slides inside the cylinder 4'A and which serves both as a bearing surface for a first end of a second spring 8, and also as a sealed closure member for the volume V2 delimited by the cylinder 4A and the piston 4B. The diameter D2 of the collar 7A is equal to the inside diameter D1 of the cylinder 1B. To do this, the diameter of the cylindrical portion 4'A is greater than that of the cylinder 4A. Sealing is ensured by a sealing ring 9. The spring 8 is the engagement spring: its second end bears against the piston 4B.

The piston 4B has an opening 10 capable of being closed by a valve 11 which is biased by a spring 12 which bears against the fixed part 7, with the valve 11 being guided by a rod 11A which is slidably received in the part 7 with sealing being provided by a sealing ring 7B.

The piston 4B also includes a non-return valve 13 allowing fluid to flow from the volume V2 to the volume V1, but preventing it from flowing in the opposite direction.

The volumes V1 and V2 are filled with a liquid 6 such as an oil for a hydraulic actuator.

The following are represented diagrammatically:

a motor 15 driving a cam 16 which co-operates with a lug 4D on the cylinder 4 in order to reset the control device;

an electromagnet 18 for displacing a catch co-operating with the collar 1C in order to release the disengagement spring 2; and an electromagnet 20 for displacing a catch member cooperating with a lug 4C on the cylinder 4 in order to cause the engagement spring 8 to operate.

Operation of the control device is described below.

In FIG. 1, the disengagement spring is relaxed (the circuit breaker is open), the abutment 1D bears against the frame, the volumes V1 and V2 are both full of liquid, the valve 11 is closed by thrust from the spring 12, the engagement spring 8 is compressed, and the cylinder 4A is held in place by catching on the electromagnet 20.

In order to compress the disegagement spring 2 (which provides a smaller force than does the engagement spring 8), the electromagnet 8 is actuated, thereby releasing the lug 4C, thus causing the spring 8 to expand (FIG. 2) and thrust against the piston 4B which, by thrusting against the liquid in the volume V1, drives the moving part 1, thereby driving the rod 1A (for closing the circuit breaker), while simultaneously compressing the disengagement spring 2. During this stage, the spring 12 keeps the valve 11 against its seat, thereby keeping the volume V1 closed.

The stroke of the valve 11 is shorter than the compression stroke of the spring 8. When the stroke of the valve 11 ends, by virtue of an end-of-stroke abutment 11A engaging the fixed part 7, the opening 10 is opened and all the liquid in the volume V1 passes into the volume V2. This passage is accelerated by the vacuum set up beneath the piston 48.

After the disengagement spring 2 has been compressed, the abutment 1C of the moving part lies beyond the catch member of the electromagnet 18. Thereafter, the moving part 1 moves back a little under the action of the spring 2 and comes to rest when its abutment 1C engages the catch member of the electromagnet 18 (FIG. 3).

The volume V2 is completely filled with oil. Above the top surface 22 of the oil there is a height H of vacuum equal to the stroke of the piston, which stroke is equal to the stroke of the rod 1A.

Figure 3:
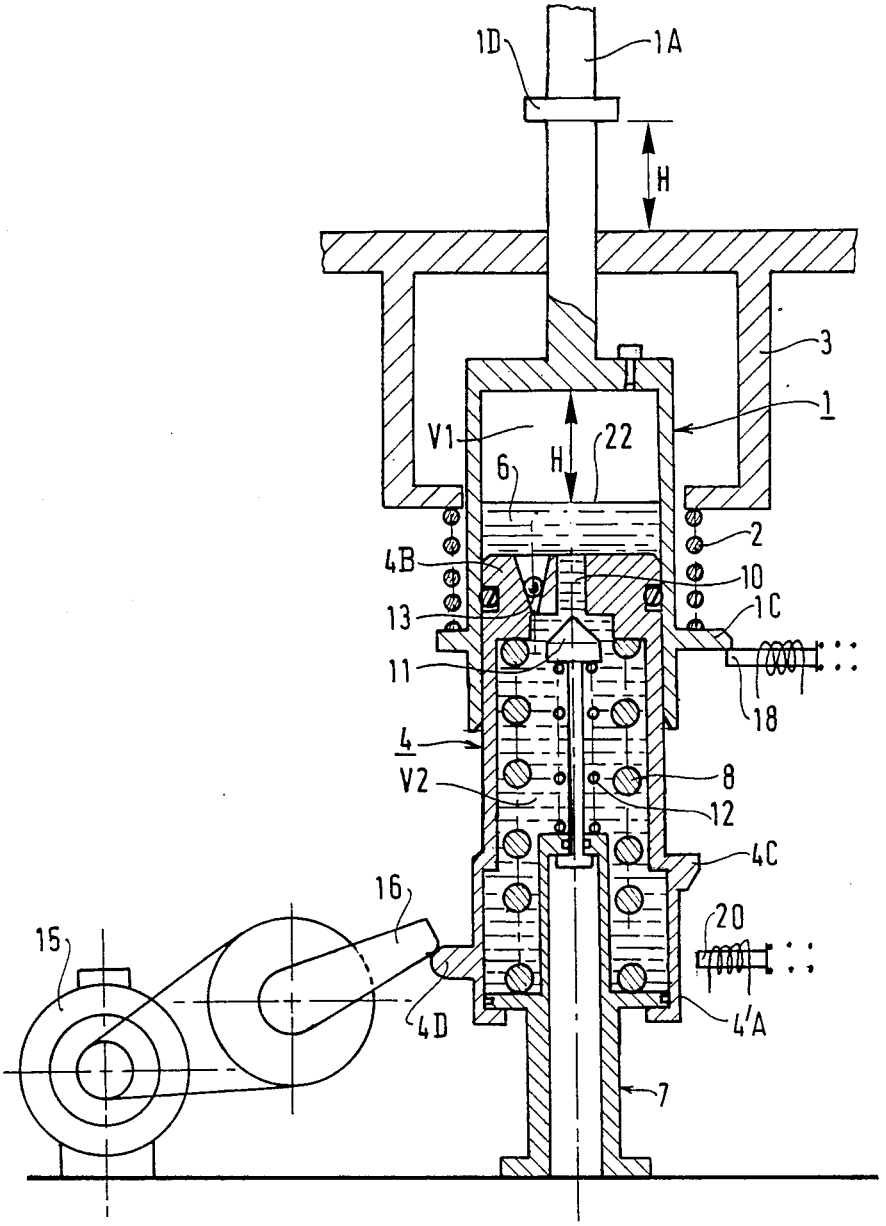
FIG. 3 is a diagrammatic view of the same control device at the end of the engagement stroke.

Starting from the position shown in FIG. 3 (circuit breaker closed, disengagement spring compressed), it is possible either to run a circuit breaker opening operation, or else to switch on the resetting device 15, 16 in order to recompress the engagement spring 8.

Figure 4:
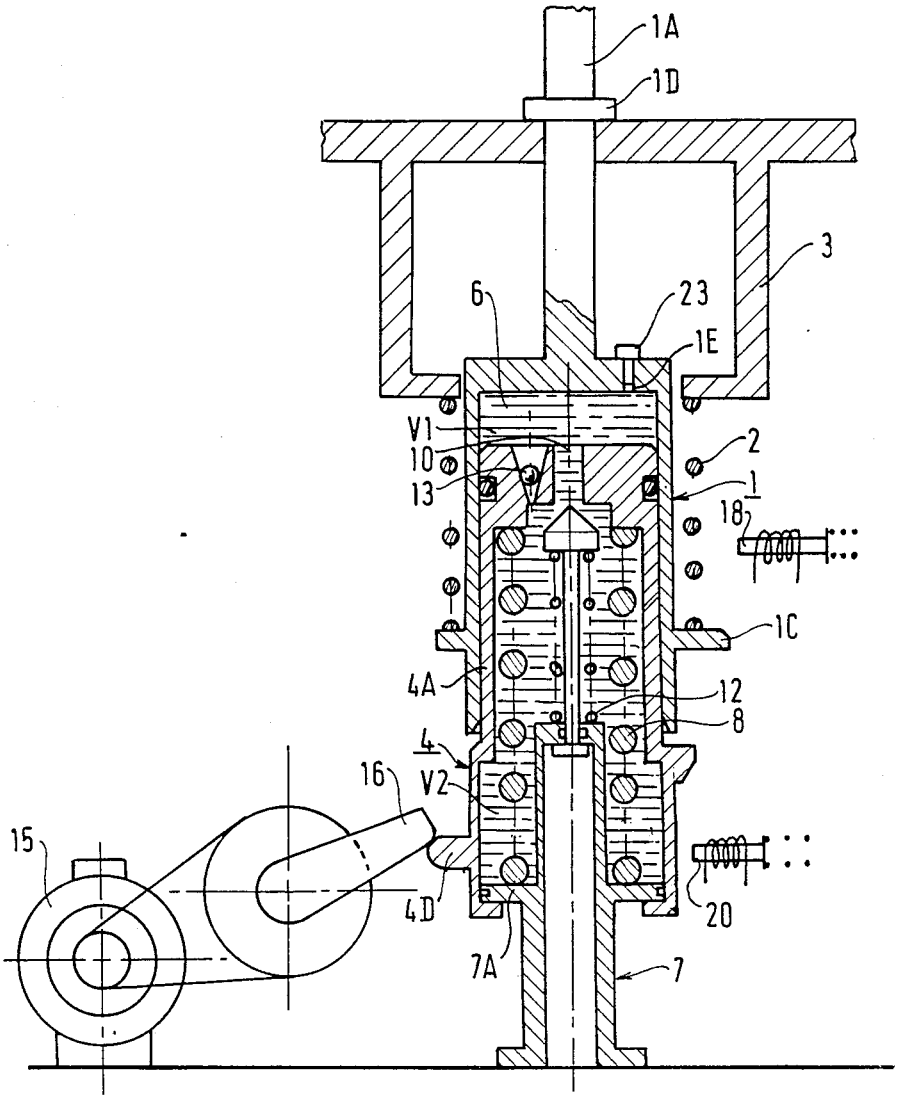
FIG. 4 is a diagrammatic view of the same control device at the end of the circuit breaker-opening stroke, with the engagement spring relaxed.

The circuit breaker opening operation is described with reference to FIG. 4.

The electromagnet 18 is actuated, thereby releasing the abutment 1C. The spring 2 expands taking the moving part 1 with it which is in turn coupled to the operating rod of the circuit breaker.

At the end of the stroke of the part 1, the abutment 1D bears against the frame 3.

All of the springs are relaxed, and the liquid occupies the entire volume delimited by the parts 1B, 4A, and 7A. Indeed, it is this position which is used for filling the volume with oil via an opening 1E in the bottom of the cylinder 1B, which opening is closed by a plug 23.

Figure 5:
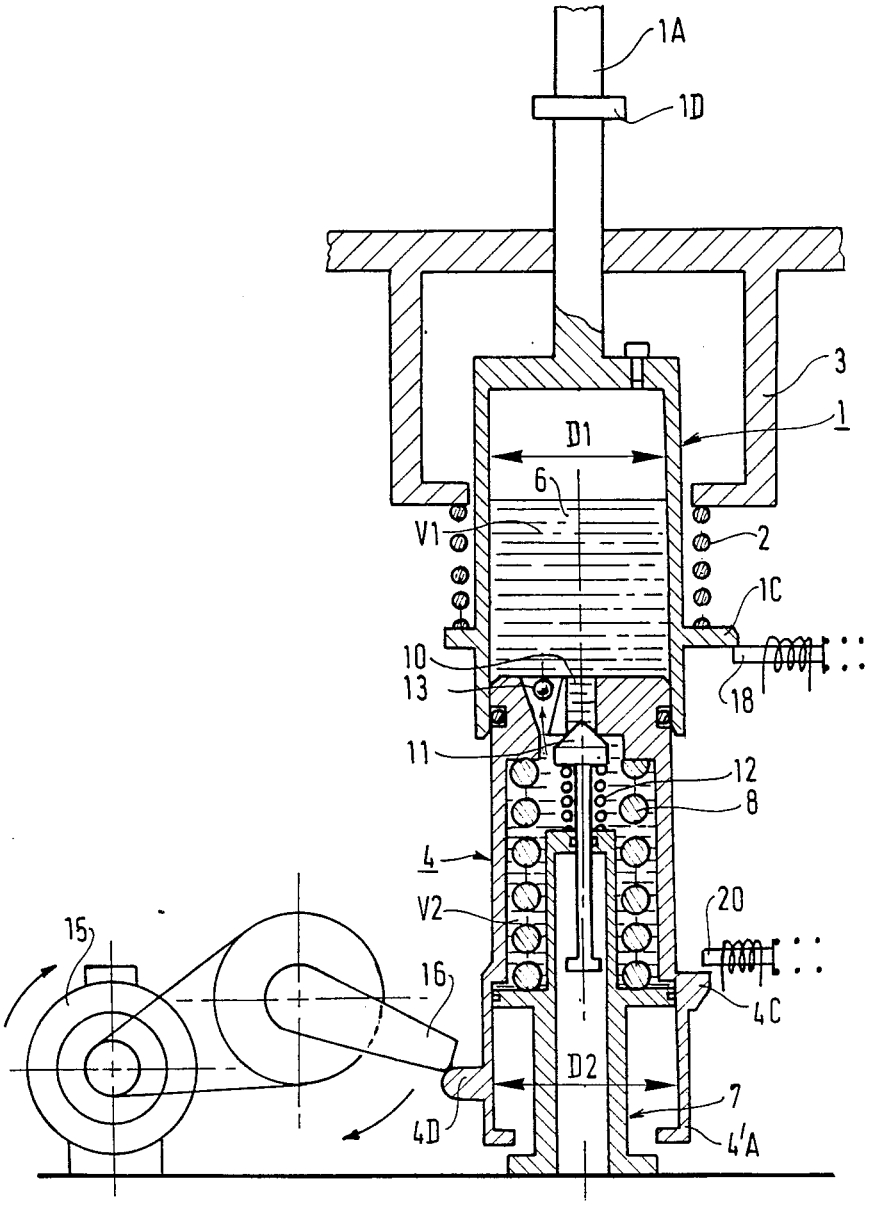
FIG. 5 is a diagrammatic view of the same control device with both its engagement and its disengagement springs compressed.

Starting from the state shown in FIG. 3, it is also possible to switch on the resetting device 15, 16 as shown in FIG. 5.

The cam 16 drives the abutment 1C, thereby displacing the part 4 and compressing the springs 8 and 12 until the abutment 4C of the part 4 catches behind the electromagnet 20.

During this operation, the valve 11 is again pressed against its seat, with liquid passing from the volume V2 to the volume V1 via the non-return valve 13.

The oil level in the volume V1 remains unchanged because the diameters D1 and D2 are equal.

Figure 2:
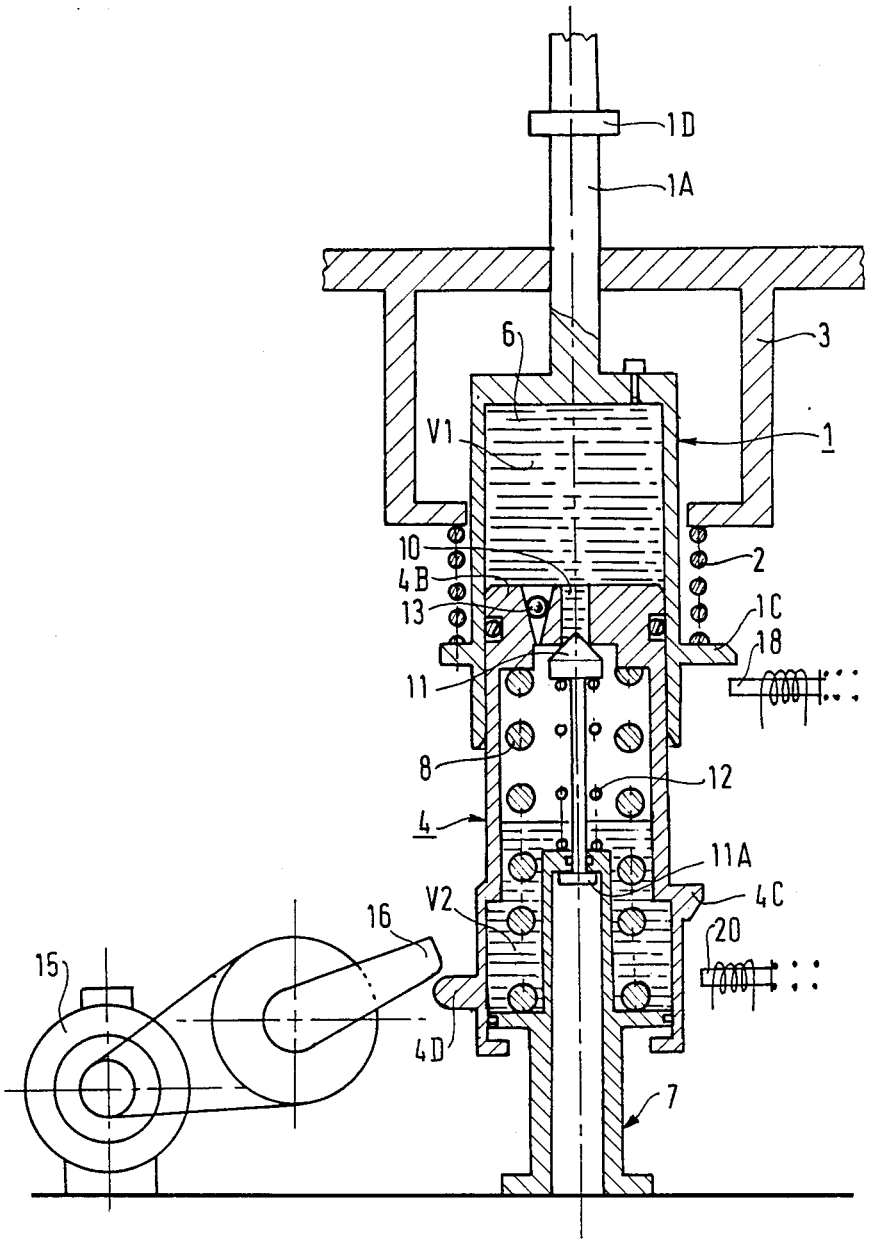
FIG. 2 is a diagrammatic view showing the same control device during engagement.

In the position shown in FIG. 5, the circuit breaker is ready to perform an open-close-open (OCO) cycle, with the first opening operation taking place as described with reference to FIG. 4, with closing taking place as described with reference to FIGS. 2 and 3, and with the second opening operation taking place as described with reference to FIG. 4.

The device of the invention achieves the desired aims and in particular it is simple in structure, reliable, and highly efficient.

All of its parts are bodies of revolution and the pressure to which the oil is subjected during engagement is low (a few bars).

The device may be coupled to a zero latching force mechanical energy storage device as described in French patent application No. 87 03 037 filed by the present Applicant on Mar. 17, 1987.

What is claimed is:

1. A mechanical control device for controlling a circuit breaker, said device comprising an engagement spring and a disengagement spring together with hydraulic means for transmitting a portion of the energy in the engagement spring to said disengagement spring, the device comprising a part which is moveable relative to a fixed frame, said part comprising a rod connected to an operating member of the circuit breaker and a first cylinder which is closed by a piston having a cylindrical body movably sliding in a sealed manner about a collar which is stationary relative to said frame, the disengagement spring surrounding said first cylinder and bearing firstly against said frame and secondly against a collar fixed to the first cylinder, the engagement spring being placed inside the cylindrical body and bearing firstly against said piston and secondly on a second collar which is fixed relative to said frame, with the inside volumes of the first cylinder and of said cylindrical body being filled with a liquid and being in communication with each other firstly via a piston orifice which is removably closed by a valve, and secondly via a non-return valve allowing liquid to pass only from the cylindrical body towards the first cylinder.

2. A device according to claim 1, wherein the cylindrical body comprises a cylinder portion in which said collar which is stationary relative to said frame is slidably received, with the inside diameter of the cylindrical portion being equal to the inside diameter of said first cylinder.

3. A device according to claim 1, wherein the piston orifice valve is placed inside the cylindrical body and is pressed against its seat by a spring bearing against a portion which is stationary relative to the frame, with the stroke of the spring being less than the stroke of the piston so that the piston orifice valve opens at the end of the circuit breaker closing stroke.

4. A device according to claim 1, wherein the first cylinder and the cylindrical body carry latching means which co-operate with control members and with resetting members.

* * * * *